US010928163B2

(12) United States Patent
Zimmer

(10) Patent No.: US 10,928,163 B2
(45) Date of Patent: Feb. 23, 2021

(54) BALLISTIC HELMET

(71) Applicant: Trent Zimmer, Houma, LA (US)

(72) Inventor: Trent Zimmer, Houma, LA (US)

( * ) Notice: Subject to any disclaimer, the term of this patent is extended or adjusted under 35 U.S.C. 154(b) by 142 days.

(21) Appl. No.: 16/151,298

(22) Filed: Oct. 3, 2018

(65) Prior Publication Data

US 2019/0101359 A1 Apr. 4, 2019

Related U.S. Application Data

(60) Provisional application No. 62/567,813, filed on Oct. 4, 2017, provisional application No. 62/612,753, filed on Jan. 2, 2018.

(51) Int. Cl.

| | |
|---|---|
| ***F41H 1/04*** | (2006.01) |
| ***A42B 3/30*** | (2006.01) |
| ***A42B 3/16*** | (2006.01) |
| ***A42B 3/04*** | (2006.01) |

(52) U.S. Cl.

CPC ..... *F41H 1/04* (2013.01); *A42B 3/04* (2013.01); *A42B 3/166* (2013.01); *A42B 3/30* (2013.01); *A42B 3/306* (2013.01); *A42B 3/0446* (2013.01)

(58) Field of Classification Search

CPC .. F41H 1/04; A42B 3/306; A42B 3/04; A42B 3/166; A42B 3/30; A42B 3/0446

See application file for complete search history.

(56) References Cited

U.S. PATENT DOCUMENTS

| | | | | | |
|---|---|---|---|---|---|
| 3,918,098 | A * | 11/1975 | Devaney | A42B 3/166 | 2/209 |
| 5,546,610 | A * | 8/1996 | Herzig | A42B 3/225 | 2/422 |
| 5,683,831 | A * | 11/1997 | Baril | A42B 3/0406 | 429/100 |
| 5,688,039 | A * | 11/1997 | Johnson | A42B 3/0446 | 362/106 |
| 6,115,846 | A * | 9/2000 | Truesdale | A42B 3/042 | 2/171.3 |
| 9,702,534 | B1 * | 7/2017 | Brion | F21V 21/084 | |
| 9,781,964 | B1 * | 10/2017 | Davis | A42B 3/0446 | |
| 10,037,754 | B1 * | 7/2018 | Hollmann | A42B 3/166 | |
| 2011/0145964 | A1 * | 6/2011 | Crye | F41H 1/04 | 2/2.5 |
| 2011/0314594 | A1 * | 12/2011 | Rogers | A42B 3/04 | 2/421 |
| 2017/0049179 | A1 * | 2/2017 | Nordin | A42B 3/166 | |
| 2017/0052000 | A1 * | 2/2017 | White | F41H 1/08 | |
| 2017/0150769 | A1 * | 6/2017 | Lebel | A42B 3/30 | |
| 2018/0180894 | A1 * | 6/2018 | Pombo | G02B 27/0176 | |

* cited by examiner

*Primary Examiner* — Khaled Annis

(74) *Attorney, Agent, or Firm* — Asgaard Patent Services, LLC; F. Wayne Thompson, Jr.

(57) ABSTRACT

Implementations of a ballistic helmet are provided. The ballistic helmet comprises two armor plates, each armor plate can be positioned to cover an ear of a wearer and thereby provide ballistic protection. In some implementations, the ballistic helmet may further comprise two earcup adapters, each earcup adapter is configured to be mounted on an interior side of an armor plate and to allow an attached earcup to rotate thereon. In this way, each earcup may be comfortably positioned over an ear of the wearer and thereby attenuate sound.

3 Claims, 10 Drawing Sheets

SECTION A-A
SCALE 1 : 2

SECTION A-A
SCALE 1 : 2

BALLISTIC HELMET

CROSS REFERENCE TO RELATED APPLICATION

This application claims the benefit of U.S. Provisional Application Ser. No. 62/567,813, which was filed on Oct. 4, 2017, and U.S. Provisional Application Ser. No. 62/612,753, which was filed on Jan. 2, 2018, the entireties of both applications are incorporated herein by reference.

TECHNICAL FIELD

This disclosure relates to implementations of a ballistic helmet that may include an adapter for each earcup secured thereto and an integrated electronic circuit configured to power and operate conductively connected electronic devices.

BACKGROUND

Helmets are worn to protect the head of the wearer from injury, in particular the brain. Modern helmets are frequently made of resin or plastic, which may be reinforced with aramid fibers. Modern combat helmets are often configured to act as a platform for mounting various electronic accessory devices that will enhance the wearer's operational capabilities.

Headsets are routinely used in both military and law enforcement settings to protect a user's hearing and to facilitate hands-free communication. Some headsets include sound attenuating earcups that are connected by a headband or other headpiece connecting structure (e.g., a helmet). Some earcups include an electronic sound dampening device to protect the wearer's hearing, while other earcups may be passive and not require any electronic aid to provide hearing protection.

Modern military and law enforcement users often find the need to power electronic accessory devices (e.g., one or more lights, a global positioning system (GPS), a thermal imager, a night vision device (NVD), a camera, etc.) that are mounted on their gear (e.g., a helmet) to enhance their operational capabilities. Further, switches or buttons used to operate each electronic accessory device need to be positioned so that they are accessible to the user.

Accordingly, it can be seen that needs exist for the ballistic helmet that may include an adapter for each earcup secured thereto and an integrated electronic circuit configured to power and operate conductively connected electronic devices disclosed herein. It is to the provision of a ballistic helmet that is configured to address these needs, and others, that the present invention in primarily directed.

SUMMARY OF THE INVENTION

Implementations of a ballistic helmet are provided.

An example ballistic helmet comprising: a first armor plate attached by a hinge to a first side of the ballistic helmet, the first armor plate is configured to provide ballistic protection; a first lever assembly operationally connected to the first armor plate, the first lever assembly includes a lever and at least one spring and is configured to selectively position the first armor plate to shield a first ear of a wearer; a second armor plate attached by a hinge to a second side of the ballistic helmet, the second armor plate is configured to provide ballistic protection; and a second lever assembly operationally connected to the second armor plate, the second lever assembly includes a lever and at least one spring and is configured to selectively position the second armor plate to shield a second ear of the wearer. The at least one spring of the first lever assembly is configured to hold the first armor plate in a position adapted to shield the first ear of the wearer when acted upon by the lever; the at least one spring of the second lever assembly is configured to hold the second armor plate in a position adapted to shield the second ear of the wearer when acted upon by the lever.

In some implementations, the ballistic helmet may further comprise two earcup adapters, each earcup adapter is configured to be mounted on an interior side of an armor plate and to allow an attached earcup to rotate thereon. In this way, each earcup may be comfortably positioned over an ear of the wearer and thereby attenuate sound.

In some implementations, a first lever assembly and a second lever assembly may be configured to position the first armor plate and its attached earcup and the second armor plate and its attached earcup, respectively, to cover an ear of a wearer. In this way, each armor plate and its attached earcup are able to provide ballistic protection and attenuate sound, respectively.

In some implementations, the first lever assembly and the second lever assembly are operationally connected to the first armor plate and the second armor plate, respectively. The lever of each lever assembly may be configured to move between a first position in which an armor plate and its attached earcup are positioned to cover an ear of a wearer and a second position in which the armor plate and its attached earcup are not positioned to cover an ear of a wearer. In this way, each armor plate, and its attached earcup, may be selectively positioned to cover an ear of a wearer. In some implementations, when the lever of both lever assemblies is in the second position, the ballistic helmet may be donned or removed by the wearer.

In some implementations, each earcup adapter may comprise a base having a ball joint extending therefrom that is configured to be received within an opening located in the backside of each earcup, the opening of each earcup may be configured to removably retain the ball joint of an earcup adapter therein. In some implementations, the ball joint of each earcup adapter may be larger in diameter than the opening in the backside of an earcup, the opening in the backside of an earcup may be configured to resiliently deform when the ball joint is being inserted therein and removed therefrom.

In some implementations, the base of each earcup adapter may be removably secured to the interior side of an armor plate. In this way, the wearer may position the attached earcup for optimal comfort during use.

In some implementations, the integrated electronic circuit of a ballistic helmet may comprise a primary printed circuit board (PCB) conductively connected to: the power sources stored in each battery pack, a battery pack selector assembly, an indicator array comprised of three light-emitting diodes (LEDs), an infrared (IR) umbrella light, a strobe light, and/or a visible umbrella light. In some implementations, the electronic circuit may also comprise a wireless communication module. In some implementations, when electronic earcups are used in conjunction with the ballistic helmet, the electronic circuit may further comprise the speaker and the microphone of each conductively connected electronic earcup. In some implementations, the electronic circuit may be configured to operate and/or power removable electrically powered devices (e.g., a flashlight, a camera, a thermal imager, a night vision device, etc.) that are conductively connected thereto.

In some implementations, each battery within a battery pack may be individually wired (i.e., conductively connected) to the PCB. In this way, a battery pack may be used to power the electronic circuit regardless of the quantity of batteries stored therein. In some implementations, through the use of two separate battery packs and the battery pack selector assembly, the electronic circuit is configured to maintain power supply continuity while expended batteries are being replaced. As long as at least one battery having sufficient voltage and/or amperage to power the electronic circuit is positioned within an operationally connected battery pack, power supply continuity will be maintained. Put another way, in some implementations, the electronic circuit can be powered by a first battery pack, even if the battery pack has less than the maximum number of batteries therein, while the batteries housed in a second battery pack are being replaced.

In some implementations, the indicator array may be configured to position the LEDs thereof below the front lip of the ballistic helmet so that they are visible to the wearer. In some implementations, the indicator array may comprise a housing configured to contain the LEDs therein.

In some implementations, the electronic circuit may include one or more sockets and/or plugs that are configured to conductively connect electronic devices (e.g., an illumination device, camera, thermal imager, etc.) thereto, thereby facilitating the transfer of power, data, or a combination thereof.

In some implementations, the ballistic helmet may include at least one interface positioned on an exterior side thereof that is configured to conductively connect an electronic device mounted thereon to the integrated electronic circuit.

BRIEF DESCRIPTION OF THE DRAWINGS

Like reference numerals refer to corresponding parts throughout the several views of the drawings.

DETAILED DESCRIPTION

Figure 1:
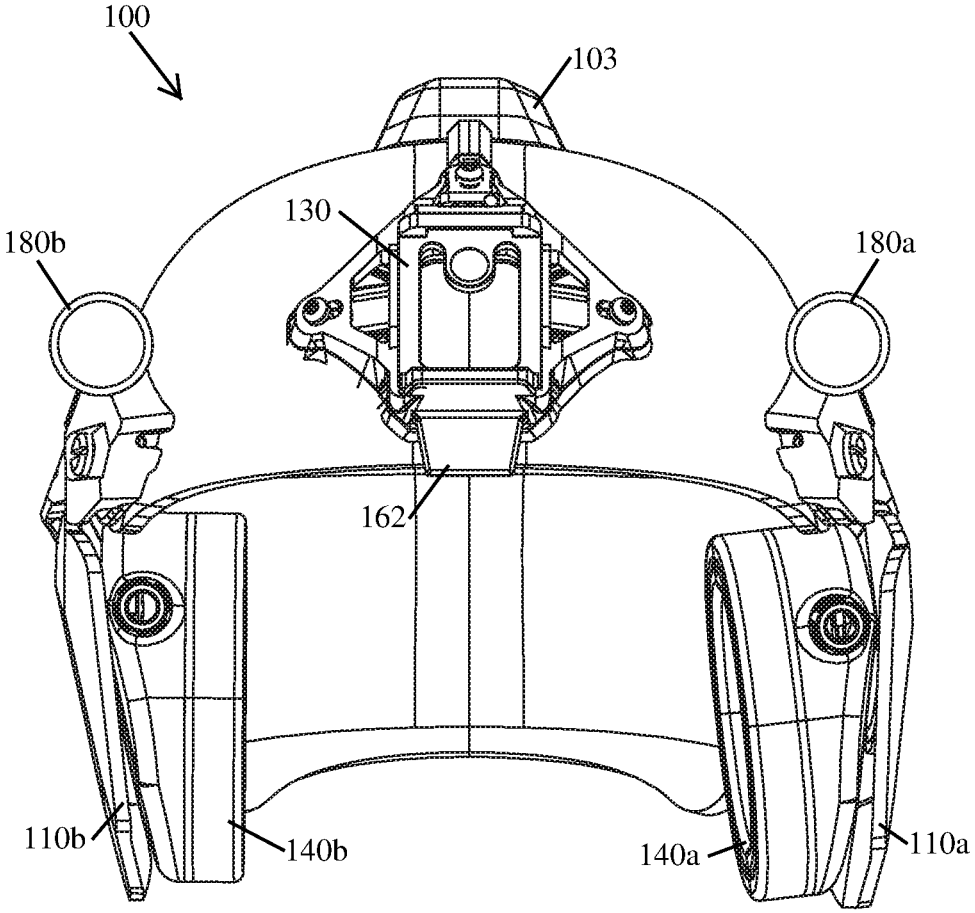
FIG. 1 illustrates a front view of a ballistic helmet according to the principles of the present disclosure.

FIGS. 1-10 illustrate an example implementation of a ballistic helmet 100 that may include an adapter for each earcup secured thereto and an integrated electronic circuit configured to power and operate conductively connected electronic devices according to the principles of the present disclosure.

As shown in FIGS. 1, 2, 5, 6, and 9, in some implementations, the ballistic helmet 100 may comprise two armor plates (110*a*, 110*b*), each armor plate 110*a*, 110*b* may be positioned to cover an ear of a wearer. In this way, each armor plate 110*a*, 110*b* is able to provide ballistic protection for one side of the wearer's head. In some implementations, the ballistic helmet 100 may further comprise two earcup adapters 120*a*, 120*b*, each earcup adapter 120*a*, 120*b* is configured to be mounted on an interior side of an armor plate 110*a*, 110*b* and to allow an attached earcup 140*a*, 140*b* to rotate thereon (see, e.g., FIGS. 6 and 9). In this way, each earcup 140*a*, 140*b* may be comfortably positioned over an ear of the wearer and thereby attenuate sound. In some implementations, the ballistic helmet 100 may also comprise an integrated electronic circuit 160 configured to operate and/or power electronic earcups 140*a*, 140*b* and other electrically powered devices (e.g., a flashlight 180*a*) conductively coupled thereto (see, e.g., FIG. 10). In some implementations, the ballistic helmet 100 may not include an integrated electronic circuit 160 (not shown).

In some implementations, the ballistic helmet 100 may be configured to meet or exceed NIJ standard-0106.01 for ballistics helmets. NIJ refers to the National Institute of Justice. In some implementations, the shell of the ballistic helmet 100 may be comprised of aramid fibers (e.g., Kevlar®), a ballistic composite material, or a combination thereof. In some implementations, the ballistic helmet 100 may not offer ballistic protection and instead be configured to protect against blunt force trauma and/or abrasions; such helmets are frequently referred to as "bump" helmets.

In some implementations, the armor plates 110*a*, 110*b* of a ballistic helmet 100 may be constructed of various materials (e.g., steel, ceramic, polymer, or a combination thereof) that will protect against small arms fire, shrapnel, spall resulting from projectile impact, and/or other high velocity projectiles. In this way, the armor plates 110*a*, 110*b* may be configured to provide ballistic protection.

In some implementations, each earcup 140*a*, 140*b* used in connection with a ballistic helmet 100 may be configured to attenuate sound and thereby act as hearing protection. In some implementations, each earcup 140*a*, 140*b* may include a rigid backing and an ear cushion 144 that is configured to encompass and surround the ear of a wearer (see, e.g., FIG. 6). In this way, sound is attenuated because vibrations and sound waves have to travel through the earcups 140*a*, 140*b* prior to reaching the auditory canal. In some implementations, each earcup 140*a*, 140*b* may be configured to abut and seal to a wearer's head around their ears.

Figure 4:
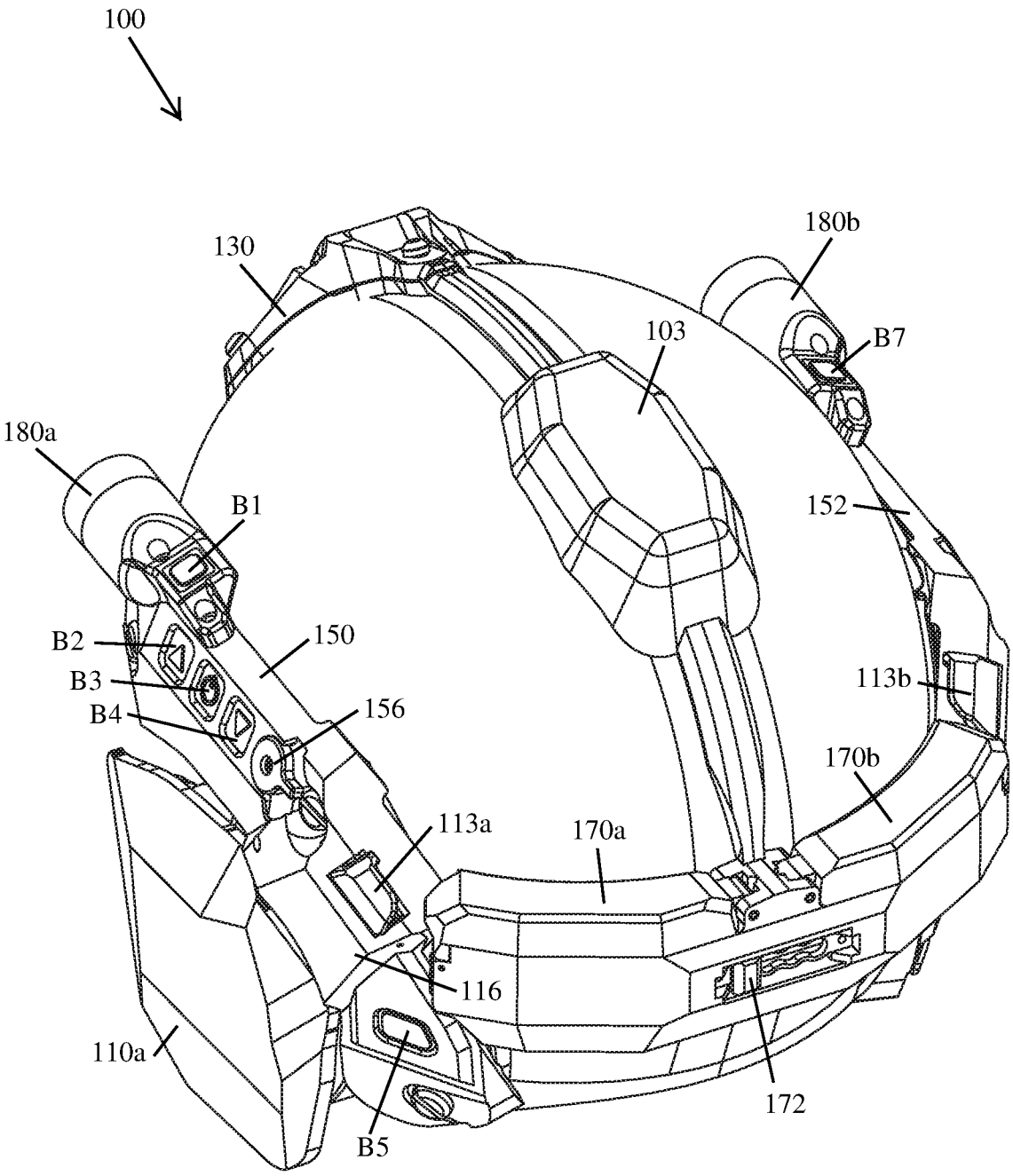
FIG. 4 illustrates a top, rear, left isometric view of the ballistic helmet shown in FIG. 1.
Figure 10:
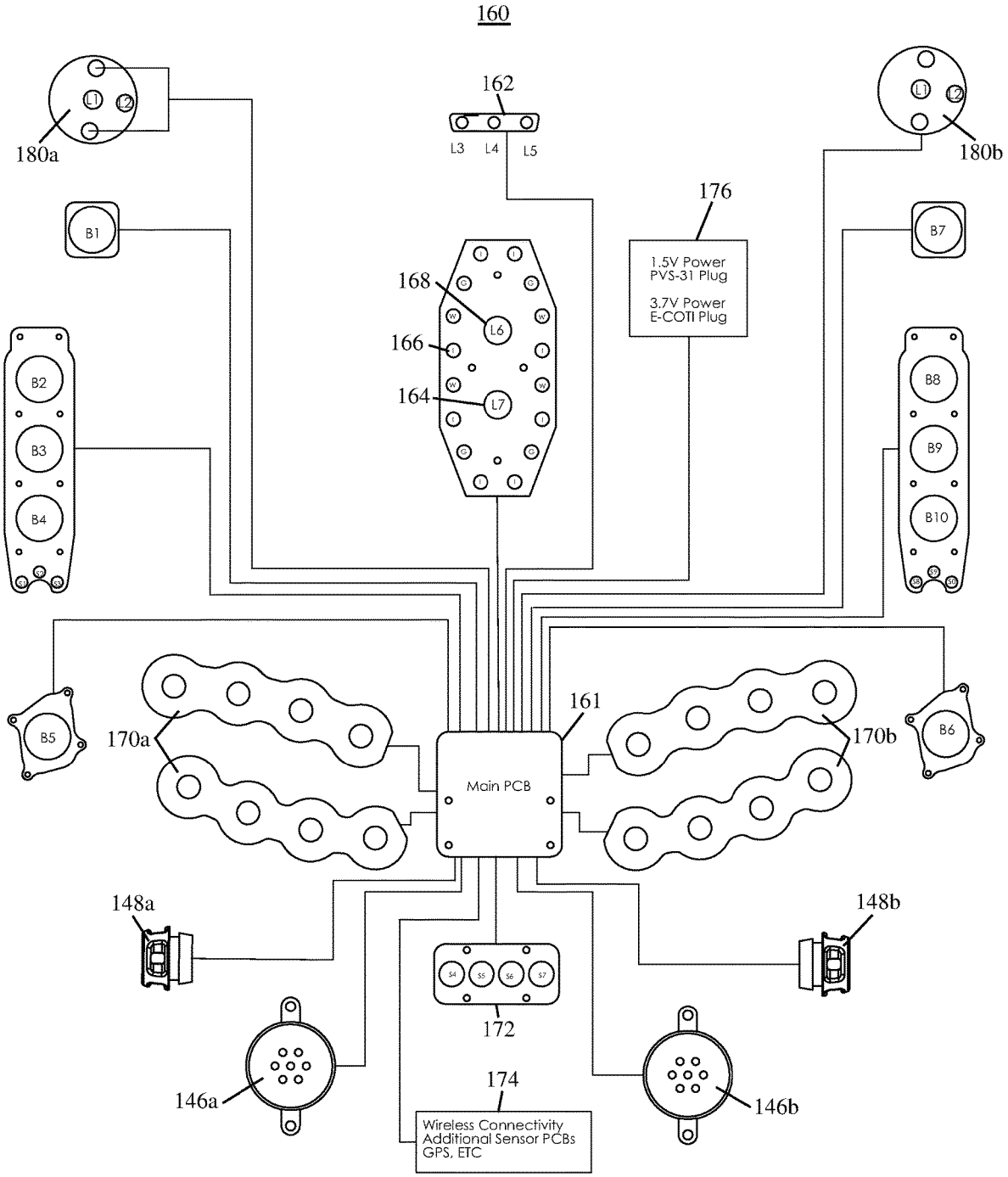
FIG. 10 illustrates an example integrated electronic circuit according to the principles of the present disclosure.

As shown in FIGS. 4 and 10, in some implementations, a portion of the circuitry (e.g., an ON/OFF switch (i.e., switch B3), volume controls (i.e., switches B2 and B4), and power source(s)) used to operate and/or power the electronic earcups 140*a*, 140*b* may be positioned elsewhere on the ballistic helmet 100. In this way, the bulk of the earcups 140*a*, 140*b* may be reduced and/or the hearing protection provided thereby increased. In some implementations, the earcups may be passive and not require any electronic aid to provide hearing protection (i.e., not electronic).

Figure 5:
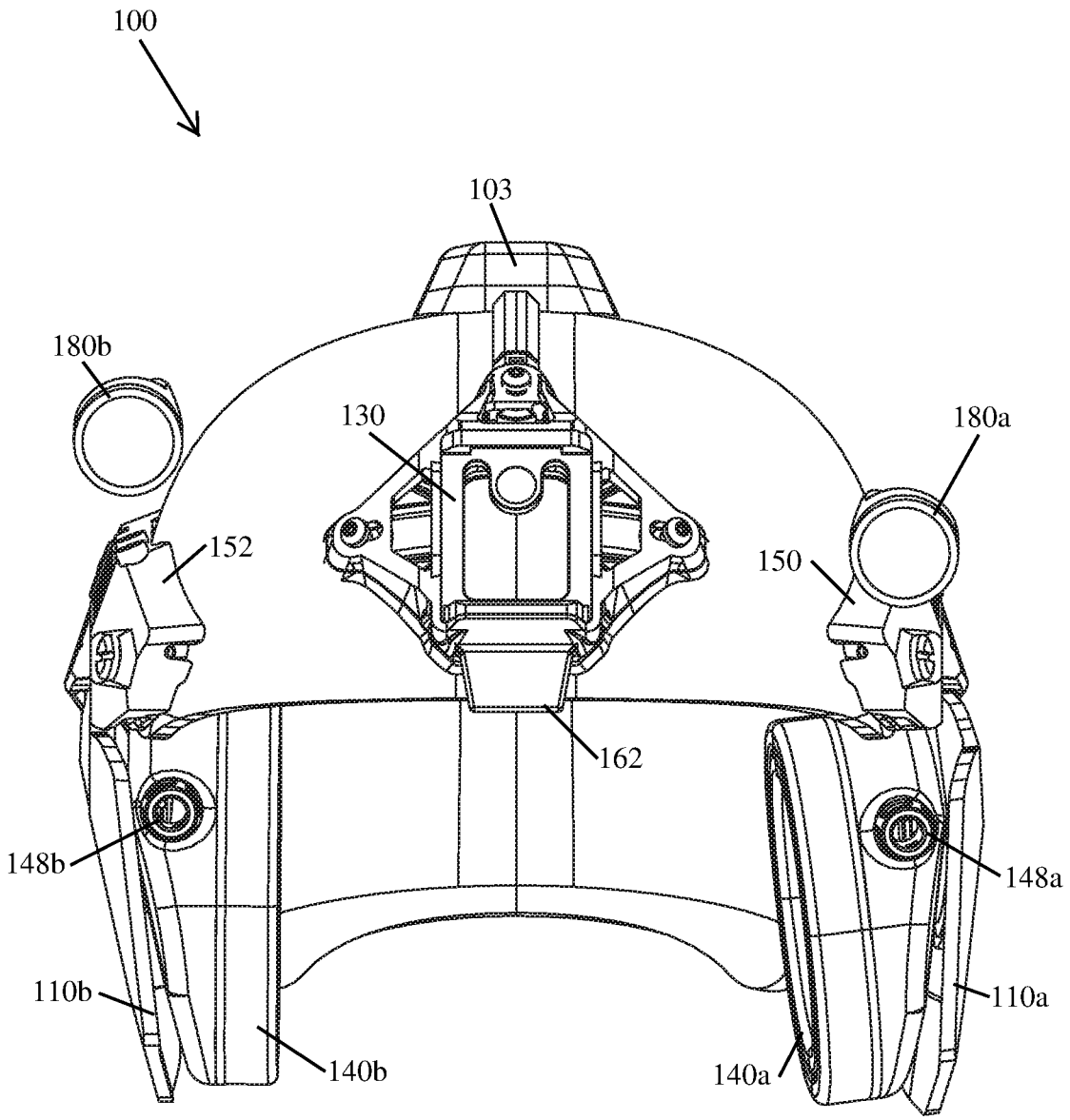
FIG. 5 illustrates a front view of the helmet shown in FIG. 1, wherein a flashlight is shown detached from the interface of the control panel.
Figure 7:
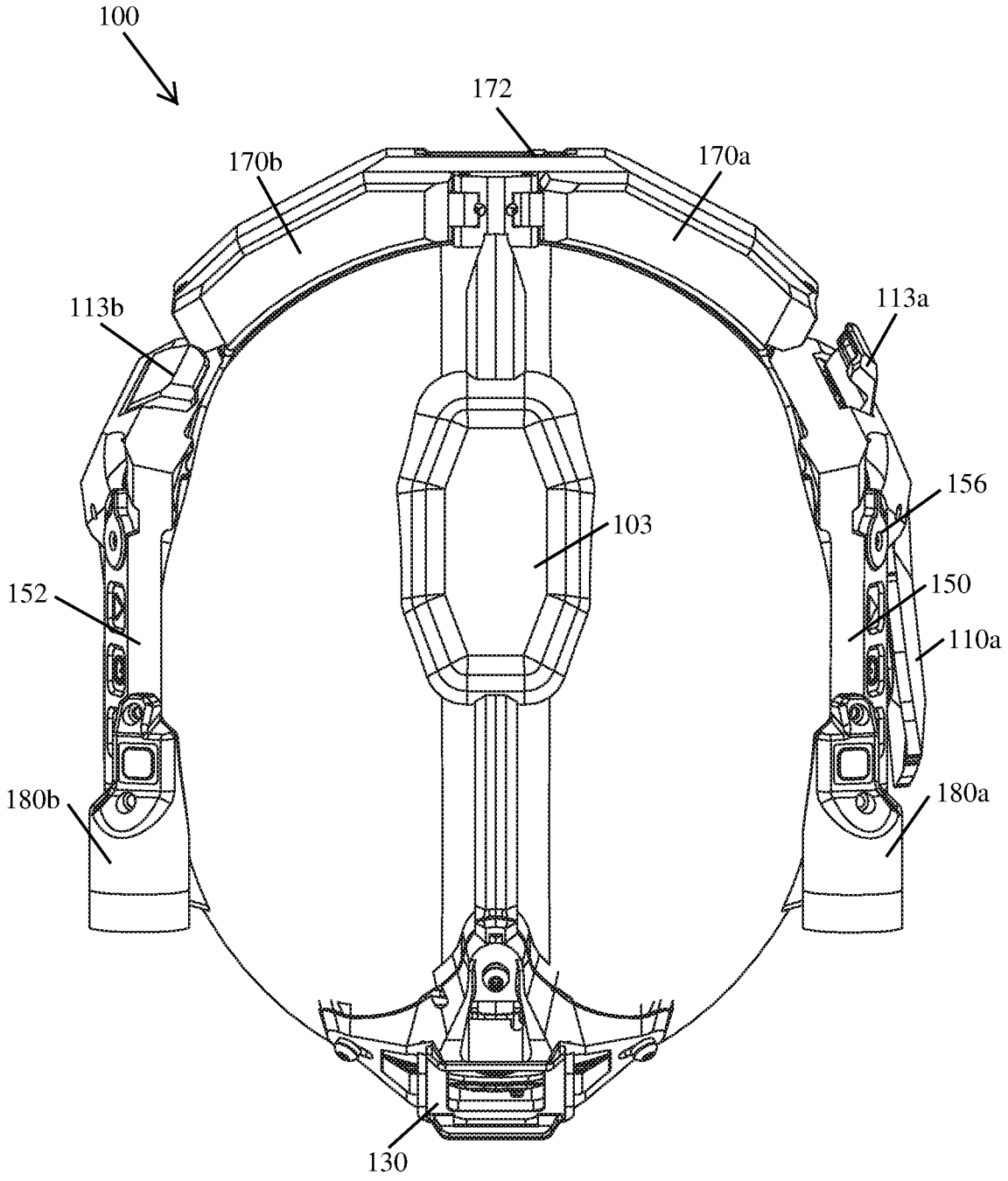
FIG. 7 illustrates a top view of the helmet shown in FIG. 1.
Figure 8:
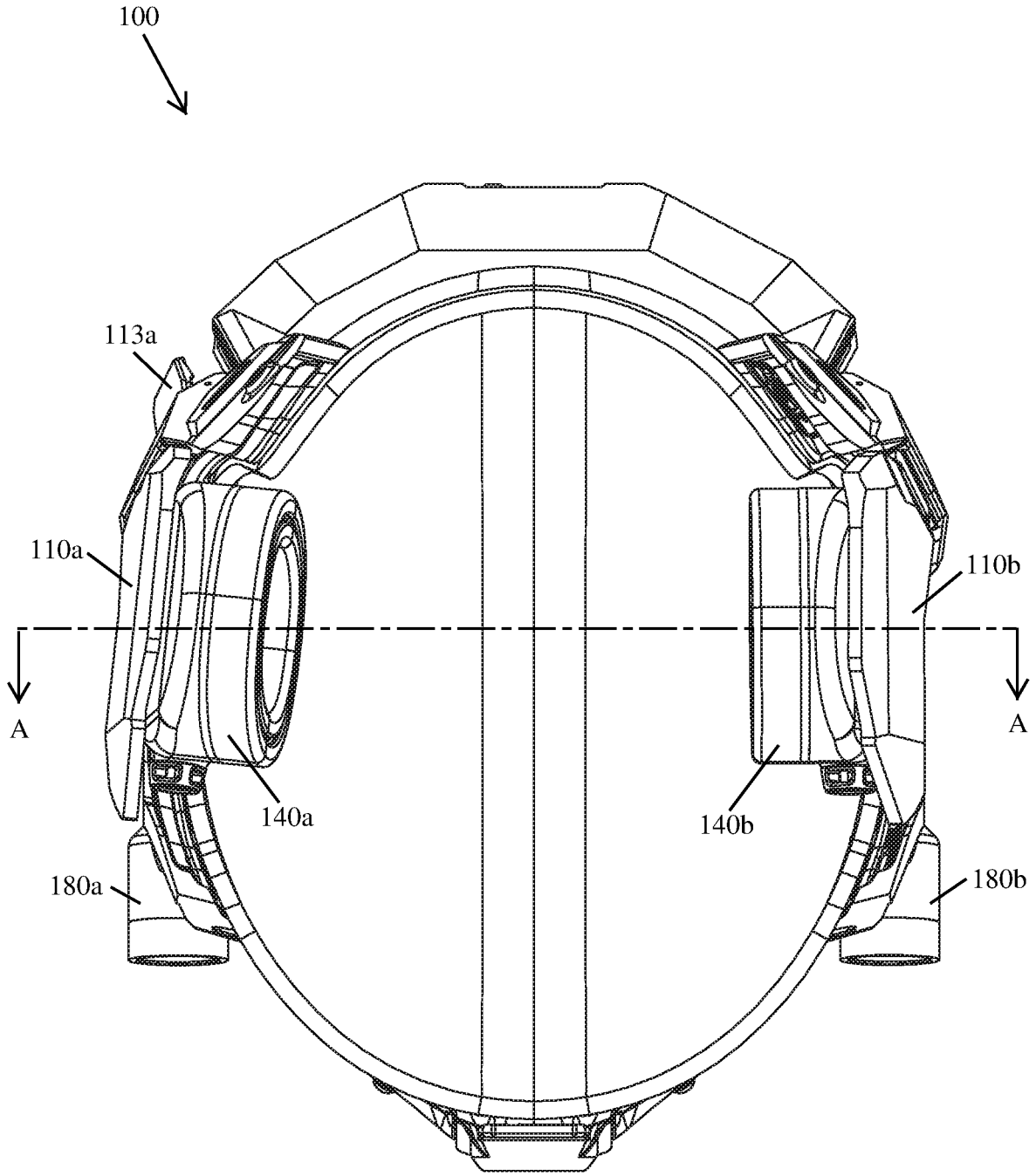
FIG. 8 illustrates a bottom view of the helmet shown in FIG. 1.

As shown in FIGS. 5 and 7, in some implementations, a first lever assembly 113*a* and a second lever assembly 113*b* may be configured to position the first armor plate 110*a* and its attached earcup 140*a* and the second armor plate 110*b* and its attached earcup 140*b*, respectively, to cover an ear of a wearer. In this way, each armor plate 110*a*, 110*b* and its attached earcup 140*a*, 140*b* are able to provide ballistic protection and attenuate sound, respectively.

In some implementations, the first lever assembly 113*a* and the second lever assembly 113*b* are operationally connected to the first armor plate 110*a* and the second armor plate 110*b*, respectively. In some implementations, the lever of each lever assembly 113*a*, 113*b* may be configured to move between a first position (e.g., lever assembly 113*b* shown in FIG. 7) in which an armor plate 110*a*, 110*b* and its attached earcup 140*a*, 140*b* are positioned to cover an ear of a wearer (e.g., armor plate 110*b* shown in FIG. 5) and a second position (e.g., lever assembly 113*a* shown in FIG. 7) in which an armor plate 110*a*, 110*b* and its attached earcup 140*a*, 140*b* are not positioned to cover an ear of a wearer (e.g., armor plate 110*a* shown in FIG. 5). In this way, each armor plate 110*a*, 110*b*, and its attached earcup 140*a*, 140*b*, may be selectively positioned to cover an ear of a wearer. In some implementations, when the lever of both lever assemblies 113*a*, 113*b* is in the second position, the ballistic helmet 100 may be donned or removed by the wearer.

In some implementations, each lever assembly 113*a*, 113*b* may include one or more torsion springs (e.g., the torsion spring 118 shown in FIG. 3) configured to hold an operationally connected armor plate 110*a*, 110*b*, and its attached earcup 140*a*, 140*b*, in a position that covers an ear of a wearer when the lever thereof is moved to the first position. In some implementations, while the ballistic helmet 100 is being worn, the torsion spring(s) 118 can compress and thereby allow each earcup 140*a*, 140*b*, and its corresponding armor plate 110*a*, 110*b*, to flex (or move). In this way, an earcup 140*a*, 140*b*, and its corresponding armor plate 110*a*, 110*b*, can adjust to comfortably accommodate the ear that it is positioned to cover.

In some implementations, the spring pressure holding an armor plate 110*a*, 110*b*, and its attached earcup 140*a*, 140*b*, in a position that covers an ear of a wearer may be removed by moving the lever, of an operationally connected lever assembly 113*a*, 113*b*, to the second position. As a result, the armor plate (e.g., 110*a*, 110*b*), and its attached earcup 140*a*, 140*b*, will pivot away from a side of a wearer's head and thereby facilitate removal of the ballistic helmet 100. In some implementations, the one or more torsion springs 118 may be configured to fix an operationally connected armor plate 110*a*, 110*b*, and its attached earcup 140*a*, 140*b*, in a position that does not cover an ear of a wearer when the lever thereof is moved to the second position.

Figure 2:
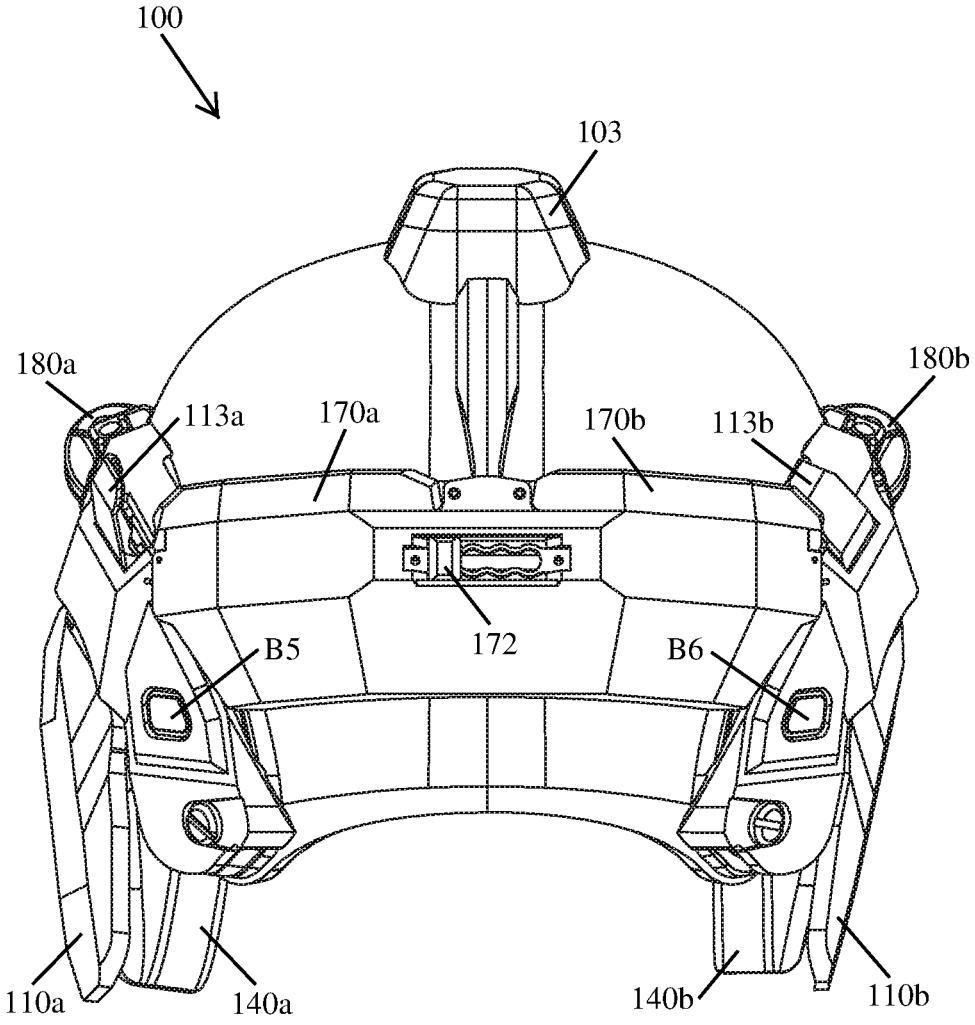
FIG. 2 illustrates a back view of the ballistic helmet shown in FIG. 1.

As shown in FIGS. 1, 2, and 5, in some implementations, the two armor plates 110*a*, 110*b* of the ballistic helmet 100 are each shaped to cover an ear of a wearer. In some implementations, when not positioned to cover an ear of the wearer by the lever assembly 113*a*, 113*b*, an armor plate 110*a*, 110*b* may pivot about a hinge 116 connecting it to the shell of the ballistic helmet 100 (see, e.g., FIG. 4). In some implementations, each armor plate 110*a*, 110*b* may be connected to the ballistic helmet 100 by a pivot or another suitable mechanical structure known to one of ordinary skill in the art.

Figure 6:
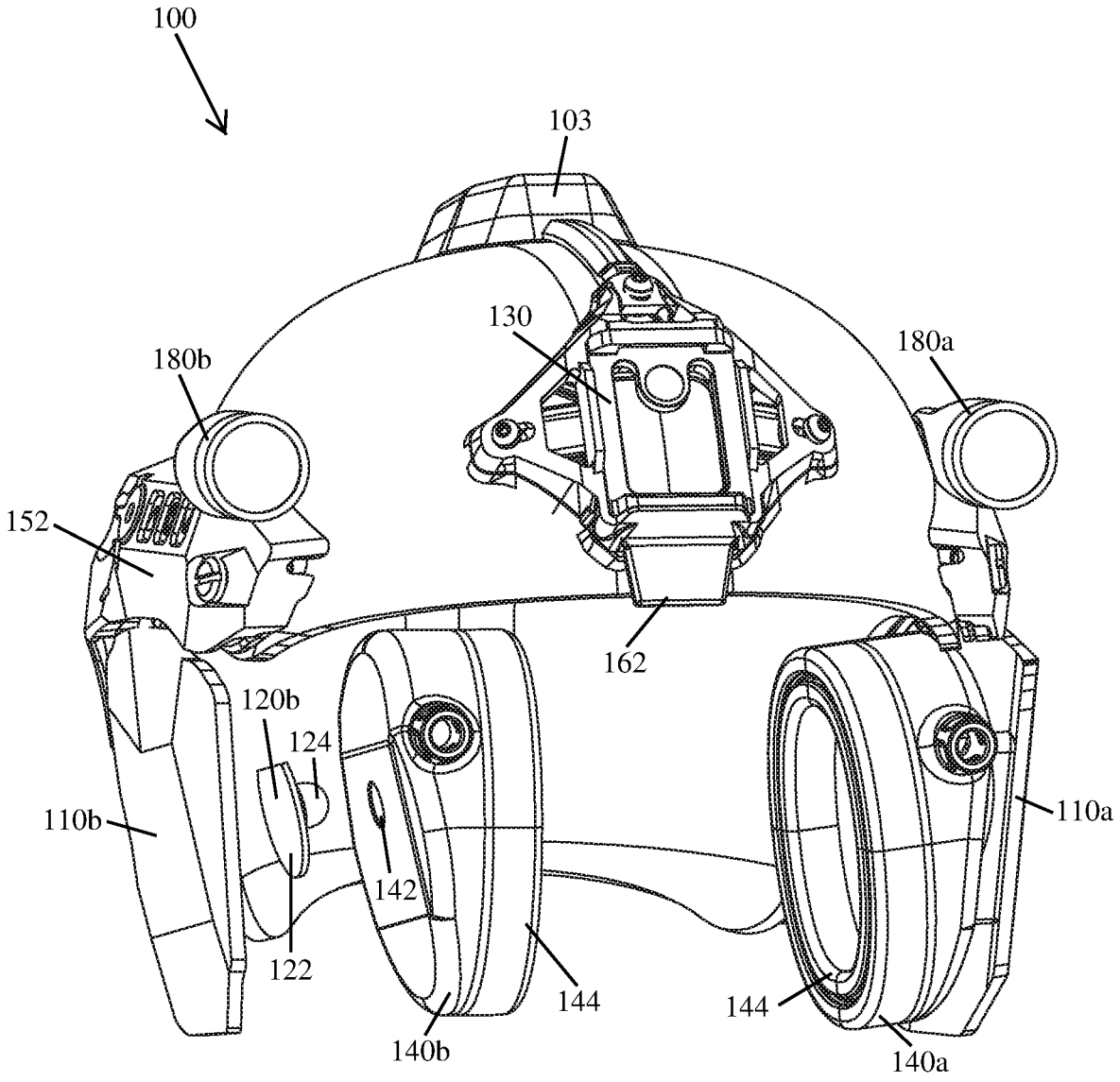
FIG. 6 illustrates a view of the helmet shown in FIG. 1, wherein an exploded view of the earcup and earcup adapter are shown.
Figure 9:
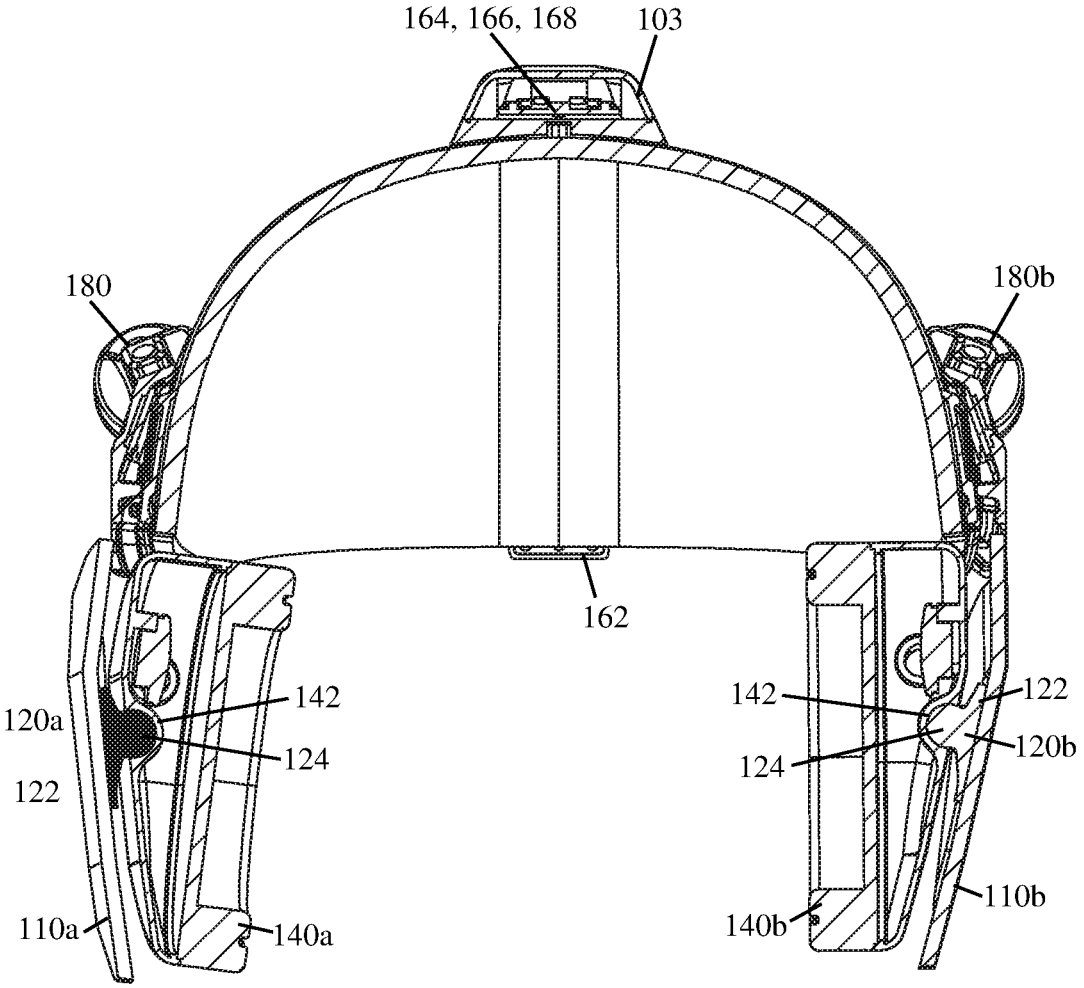
FIG. 9 illustrates a cross-sectional view of the ballistic helmet taken along line A-A of FIG. 8.

As shown in FIGS. 6 and 9, in some implementations, each earcup adapter 120*a*, 120*b* may comprise a base 122 having a ball joint 124 extending therefrom that is configured to be received within an opening 142 located in the backside of each earcup 140*a*, 140*b*. In some implementations, the opening 142 of each earcup 140*a*, 140*b* may be configured to removably retain the ball joint 124 of an earcup adapter 120*a*, 120*b* therein. In some implementations, the ball joint 124 of each earcup adapter 120*a*, 120*b* may be larger in diameter than the opening 142 in the backside of an earcup 140*a*, 140*b*. In some implementations, the opening 142 in the backside of an earcup 140*a*, 140*b* may be configured to resiliently deform when the ball joint 124 is being inserted therein and removed therefrom.

As shown in FIGS. 6 and 9, in some implementations, the base 122 of each earcup adapter 120*a*, 120*b* may be removably secured to the interior side of an armor plate 110*a*, 110*b*. In this way, the wearer may position the attached earcup 140*a*, 140*b* for optimal comfort during use. In some implementations, each earcup adapter 120*a*, 120*b* may be removably secured to the interior side of an armor plate 110*a*, 110*b* using hook-and-loop fasteners (e.g., Velcro). In some implementations, an earcup adapter 120*a*, 120*b* may be secured to the interior side of an armor plate 110*a*, 110*b* using any suitable fastener, adhesive, or combination thereof known to one of ordinary skill in the art.

As shown in FIG. 10, in some implementations, the integrated electronic circuit 160 of a ballistic helmet 100 may comprise a primary printed circuit board 161 (PCB) conductively connected to the power sources stored in each battery pack 170*a*, 170*b*, a battery pack selector assembly 172, an indicator array 162 comprised of three light-emitting diodes (LEDs), an infrared (IR) umbrella light 164, a strobe light 166, a visible umbrella light 168, or a combination thereof. In some implementations, the electronic circuit 160 may also comprise a wireless communication module 174. In some implementations, when electronic earcups 140*a*, 140*b* are used in conjunction with the ballistic helmet 100, the electronic circuit 160 may further comprise the speaker (e.g., 146*a*, 146*b*) and the microphone (e.g., 148*a*, 148*b*) of each conductively connected electronic earcup 140*a*, 140*b*. In some implementations, the electronic circuit 160 may be configured to operate and/or power a flashlight (e.g., flashlight 180*a*), a camera, a thermal imager, and/or a night vision device that is conductively connected thereto. In some implementations, the electronic circuit 160 may also include a spectrum selector switch 156 (see, e.g., FIG. 3).

In some implementations, the primary PCB 161 may comprise a logic board configured to control the operation of electronic devices conductively connected thereto (e.g., the speaker(s) 146*a*, 146*b*, the microphone(s) 148*a*, 148*b*, the LEDs of the indicator array 162, etc.). In some implementations, the PCB 161 may also comprise a circuit(s) configured to increase and/or degree the voltage and/or amperage received by an electronic device conductively connected to the electronic circuit 160. In this way, the PCB 161 may be configured to ensure that a conductively connected electronic device receives the requires voltage and/or amperage regardless of which battery back 170*a*, 170*b* is operationally connected thereto, or the number of batteries in the operationally connected battery pack 170*a*, 170*b*.

As shown in FIGS. 4 and 10, in some implementations, there may be four batteries (i.e., electrochemical cells) stored in each battery pack 170*a*, 170*b* removably secured to the backside of the ballistic helmet 100. In some implementations, each battery pack 170*a*, 170*b* may be conductively connected to the PCB 161 and thereby the rest of the electronic circuit 160 (see, e.g., FIG. 10). In some implementations, each battery within a battery pack 170*a*, 170*b* may be individually wired (i.e., conductively connected) to the PCB 161. In this way, a battery pack 170*a*, 170*b* may be used to power the electronic circuit 160 regardless of the quantity of batteries stored therein. In some implementations, each battery pack 170*a*, 170*b* may be configured to house more than four, or less than four, batteries therein.

In some implementations, the battery pack selector assembly 172 may be configured to selectively energize (i.e., turn ON/OFF) the electronic circuit 160 and any electronic devices conductively connected thereto. In some implementations, the battery pack selector assembly 172 may be mounted between the battery packs 170*a*, 170*b* (see, e.g., FIG. 2). In some implementations, the battery pack selector assembly 172 may be a slide switch assembly having at least four positions, each position includes at least one switch. In some implementation, each position (e.g., position S4, S5, S6, and S7) of the battery pack selector assembly 172 may include a reed switch and/or a magnetic sensor. In some implementations, when the battery pack selector assembly 172 is set to the first position (i.e., position S4) the electronic circuit 160 is turned OFF. In some implementations, when the battery pack selector assembly 172 is set to the second position (i.e., position S5) the electronic circuit 160 is operationally connected to the power source(s) contained in the first battery pack 170*a*. In some implementations, when the battery pack selector assembly 172 is set to the third position (i.e., position S6) the electronic circuit 160 is operationally connected to the power source(s) contained in the second battery pack 170*b*. In some implementations, when the battery pack selector assembly 172 is set to the fourth position (i.e., position S7) the electronic circuit 160 is operationally connected to the power source(s) contained in both the first and second battery packs 170*a*, 170*b*. In some implementations, the battery pack selector assembly 172 may include more than four positions.

In some implementations, through the use of two separate battery packs 170*a*, 170*b* and the battery pack selector assembly 172, the electronic circuit 160 is configured to maintain power supply continuity while expended batteries are being replaced. As long as at least one battery having sufficient voltage and/or amperage to power the electronic circuit 160 is positioned within an operationally connected battery pack 170*a*, 170*b*, power supply continuity will be maintained. Put another way, in some implementations, the electronic circuit 160 can be powered by a single battery pack (e.g., battery pack 170*a*), even if the battery pack has less than the maximum number of batteries therein, while the batteries housed in the other battery pack (e.g., battery pack 170*b*) are being replaced.

As shown in FIG. 4, in some implementations, the ballistic helmet 100 may include an umbrella light housing 103. In some implementations, the umbrella light housing 103 may contain the infrared (IR) umbrella light 164, the strobe light 166, the visible umbrella light 168, or a combination thereof. In some implementations, the umbrella light housing 103 may be positioned on the crown of the ballistic helmet 100 (see, e.g., FIG. 4). In some implementations, the umbrella light housing 103 may be configured to focus light generated therein, by the (IR) umbrella light 164, the strobe light 166, and/or the visible umbrella light 168, upwardly so that it can reflect off of a ceiling and thereby illuminate the room.

As shown in FIGS. 5 and 9, in some implementations, the indicator array 162 may be configured to position the LEDs thereof below the front lip of the ballistic helmet 100 so that they are visible to the wearer. In some implementations, the LEDs of the indicator array 162 may be conductively connected to the PCB 161 (see, e.g., FIG. 10). In some implementations, the indicator array 162 may comprise a housing configured to contain the LEDs therein.

In some implementations, the first LED (i.e., element L3 shown in FIG. 10) may be multi-colored (e.g., red, yellow, green). In some implementations, the first LED (L3) glows a dim green when the first battery pack 170*a* is between 50-100% of capacity. In some implementations, the first LED (L3) glows yellow when the first battery pack 170*a* is between 25-49% of capacity. In some implementations, the first LED (L3) glows red when the first battery pack 170*a* is between 10-24% of capacity. In some implementations, the first LED (L3) flashes red when the first battery pack 170*a* is between 0-9% of capacity (e.g., 0.1 seconds ON/0.2 seconds OFF).

In some implementations, the second LED (i.e., element L4 shown in FIG. 10) may be multi-colored (e.g., red and yellow). In some implementations, the second LED (L4) glows yellow when the strobe light 166 is ON. In some implementations, the second LED (L4) glows red when a conductively connected device (e.g., a camera) is ON. In some implementations, the second LED (L4) alternately glows red and yellow when a conductively connected device (e.g., a camera) and the strobe light 166 are ON (e.g., glows red for 0.5 seconds then yellow for 0.5 seconds).

In some implementations, the third LED (i.e., LED L5 shown in FIG. 10) may be multi-colored (e.g., red, yellow, green). In some implementations, the second LED (L5) glows a dim green when the first battery pack 170*b* is between 50-100% of capacity. In some implementations, the third LED (L5) glows yellow when the second battery pack 170*b* is between 25-49% of capacity. In some implementations, the third LED (L5) glows red when the second battery pack 170*b* is between 10-24% of capacity. In some implementations, the third LED (L5) flashes red when the second battery pack 170*b* is between 0-9% of capacity (e.g., 0.1 seconds ON/0.2 seconds OFF).

In some implementations, the indicator array 162 may include more than three, or less than three, LEDs.

In some implementations, the indicator array 162 may be replaced by a liquid-crystal display (LCD), or other similar device, that extends below the front lip of the ballistic helmet 100 so that the display is visible to the wearer (not shown). In some implementations, the LCD may be configured to show the remaining capacity of the first battery pack 170*a*, the second battery pack 170*b*, or a combination thereof. In some implementations, the LCD may be configured to display the operational status of any electronic device conductively connected to the PCB 161 of the integrated electronic circuit 160 (e.g., is a particular device ON/OFF, etc.).

In some implementations, the IR umbrella light 164 may be an infrared (IR) LED. In some implementations, the IR umbrella light 164 may be conductively connected to the PCB 161 (see, e.g., FIG. 10).

In some implementations, the visible umbrella light 168 may be a 600-1000 lumen white LED. In some implementations, the visible umbrella light 168 may be an LED configured to emit less than 600 lumens and/or more than 1000 lumens of light. In some implementations, the visible umbrella light 168 may be conductively connected to the PCB 161 of the electronic circuit 160 (see, e.g., FIG. 10).

In some implementations, the IR umbrella light 164 and/or the visible umbrella light 168 can be turned ON/OFF by pressing an umbrella light activation switch (i.e., switch B5), mounted on the ballistic helmet 100, that is conductively connected to the PCB 161 and thereby the umbrella light(s) 164, 168 (see, e.g., FIG. 10).

In some implementations, the strobe light 166 may comprise a plurality of LEDs positioned within the light housing 103. In some implementations, each LED of the strobe light 166 may be configured to emit visible light or infrared (IR) light. In some implementations, the strobe light 166 may be conductively connected to the PCB 161. In some implementations, the strobe light 166 can be turned ON/OFF by pressing a strobe activation switch (i.e., switch B6), mounted on the ballistic helmet 100, that is conductively connected to the PCB 161 and thereby the strobe light 166. In some implementations, the strobe activation switch (i.e. switch B6) may be used to select a mode of operation (or program) for the one or more LEDs of the strobe light 166. In some implementations, the program(s) controlling the operation of the strobe light 166 may be stored in the nonvolatile memory of the logic board mounted on the PCB 161.

As shown in FIG. 10, in some implementations, a wireless communication module 174 may be conductively connected to the PCB 161. In some implementations, the wireless communication module 174 may be configured to facilitate changes to the nonvolatile memory of the logic board on the PCB 161. In this way, the operation of the one or more switches (e.g., switches B1, B2, B3, B4. B5, B6, B7, etc.) conductively connected to the PCB 161 may be set and/or changed. In some implementations, changing the operation of the one or more switches may include, but is not limited to, setting which switch (e.g., B5 or B1), or switches, is operationally connected to an electronic device (e.g., the visible umbrella light 168) of the electronic circuit 160 and/or an electronic device (e.g., the flashlight 180*a*) conductively connected to the PCB 161 of the electronic circuit 160. In some implementations, the wireless communication module 174 may be configured to facilitate changing the operation parameters of electronic devices conductively connected to the PCB 161 of the electronic circuit 160. In some implementations, changing the operation parameters of the one or more electronic devices conductively connected to the PCB 161 may include, but is not limited to, setting how a device (e.g., flashlight 180*a*) will operate (e.g., strobe, constant ON, momentary ON) when the operationally connected switch (e.g., B1), or switches, is actuated. In some implementations, the wireless communication module 174 may include a USB port.

In some implementations, the PCB 161 may further comprise an electronic sound dampening device (not shown, but well known to those of ordinary skill in the art). An example sound dampening device may include a microphone 148*a*, 148*b* positioned on an outer surface of each earcup 140*a*, 140*b* (see, e.g., FIG. 1). Each microphone 148*a*, 148*b* may be configured to pick up ambient sounds from around the wearer and transmit the ambient sounds to a sound compression or suppression circuit mounted on the PCB 161 that filters out or suppresses sounds above a predetermined decibel level. Sounds lower than the set level are transmitted to a speaker 146*a*, 146*b* located inside each earcup 140*a*, 140*b* so that the wearer can hear non-damaging sounds in the surrounding environment (e.g., people talking nearby).

As shown in FIG. 10, in some implementations, an example sound dampening circuit may be adjusted by a volume switch (e.g., switch B2 and switch B4), mounted on the ballistic helmet 100, that is conductively connected to the sound dampening device on the PCB 161. In some implementations, the first audio switch B2 may be configured to increase the volume, and the third audio switch B4 may be configured to decrease the volume, of the speakers 146*a*, 146*b*. In some implementations, the volume of the speakers 146*a*, 146*b* may be incrementally increased or decreased each time the first audio switch B2 or the third audio switch B4, respectively, is pressed.

In some implementations, an example sound circuit may be turned ON/OFF by pressing a second audio switch B3, mounted on the ballistic helmet 100 between the first audio switch B2 and the third audio switch B4, that is conductively connected to the sound dampening device on the PCB 161. In some implementations, the second audio switch B3 may need to be depressed for 3 seconds in order to turn the sound dampening circuit ON/OFF.

As shown in FIGS. 5 and 10, in some implementations, a flashlight 180*a* may be removably secured to the ballistic helmet 100 and conductively connected to the PCB 161 of the electronic circuit 160. In some implementations, the flashlight 180*a* may be removably secured to an interface on the audio control panel 150 that is mounted on a first side of the ballistic helmet 100 (see, e.g., FIG. 3). In some implementations, the interface on the audio control panel 150 may include contacts that are conductively connected to the PCB 161 of the electronic circuit 160. In some implementations, the interface may be configured to conductively interface directly with the flashlight 180*a* mounted thereto. In some implementations, the flashlight 180*a* may be configured to emit both white and infrared (IR) light. In some implementations, the flashlight 180*a* can be turned ON/OFF by pressing the flashlight control switch B1 that is conductively connected to the PCB 161 and thereby the white light LED (L1) and/or the IR LED (L2) of the flashlight 180*a*. In some implementations, the flashlight control switch B1 may need to be depressed for 1 second in order to turn the flashlight 180*a* ON/OFF.

As shown in FIG. 5, in some implementations, a second flashlight 180*b* may be removably secured to the ballistic helmet 100 and conductively connected to the PCB 161 of the electronic circuit 160. In some implementations, the second flashlight 180*b* may be removably secured to an interface on the control panel 152 that is mounted on a second side of the ballistic helmet 100. In some implementations, the interface on the control panel 152 may include contacts that are conductively connected to the PCB 161 of the electronic circuit 160. In some implementations, the interface may be configured to conductively interface directly with the flashlight 180*b* mounted thereto. In some implementations, the second flashlight 180*b* may be turned ON/OFF by pressing a flashlight control switch B7 that is conductively connected to the PCB 161 and thereby the flashlight 180*b* (see, e.g., FIG. 10).

In some implementations, the interface of either control panel 150, 152 may be configured so that a camera (or another suitably configured electrically powered device), in-lieu of a flashlight (e.g., 180*a*, 180*b*), can be removably secured thereto and conductively connected to the PCB 161 of the electronic circuit 160. In some implementations, when a camera is mounted on the interface of either control panel (150, 152), the camera may be turned ON/OFF by pressing the control switch (e.g., switch B1 or B7) that is conductively connected to the PCB 161 and thereby the camera.

Figure 3:
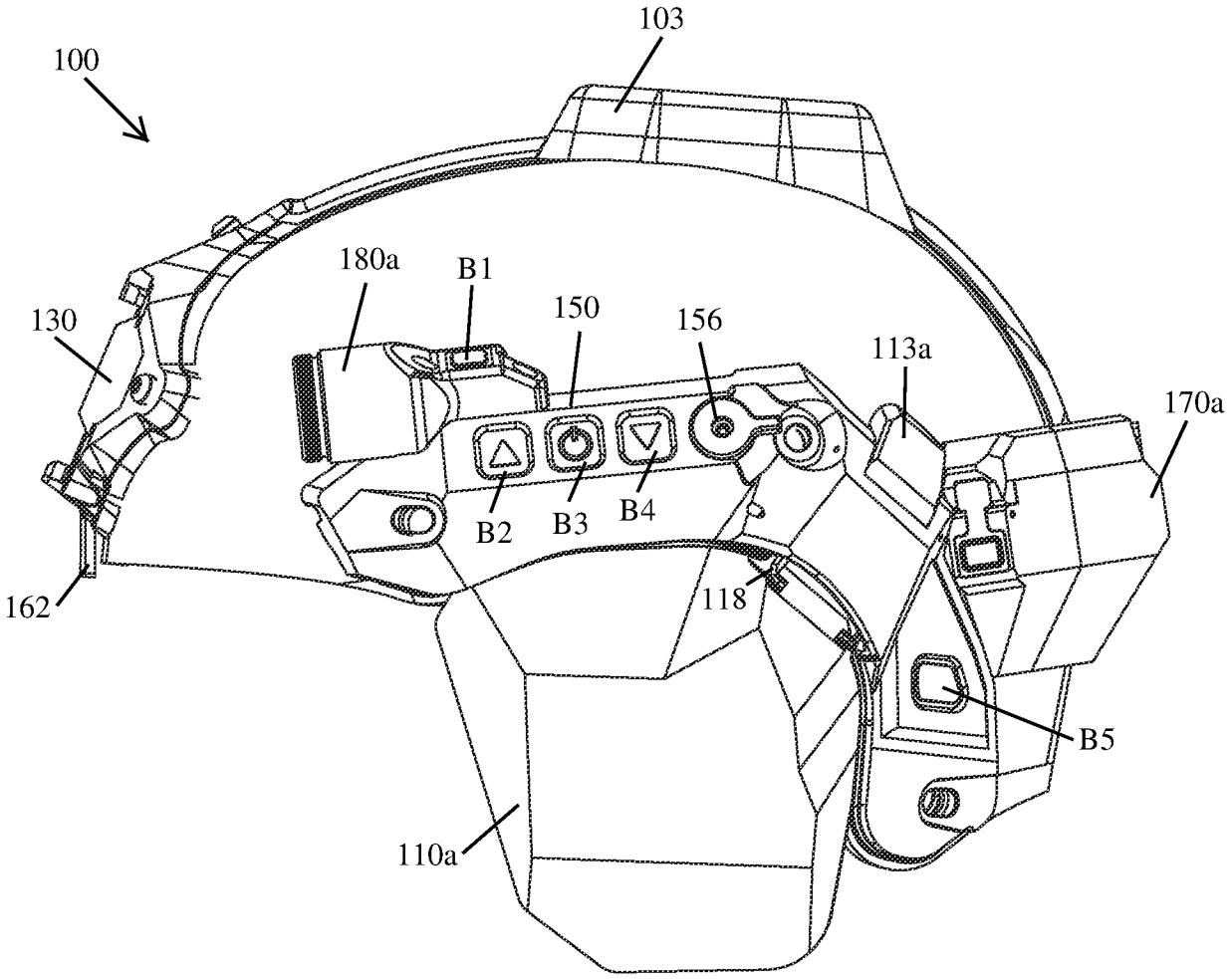
FIG. 3 illustrates a left side view of the ballistic helmet shown in FIG. 1.

As shown in FIG. 3, in some implementations, the spectrum selector switch 156 may be positioned on an exterior side of the ballistic helmet 100. In some implementations, the spectrum selector switch 156 may be conductively connected to the PCB 161 and thereby the rest of the electronic circuit 160. In some implementations, the spectrum selector switch 156 may be configured to switch a device (e.g., the flashlight 180*a*), or multiple devices, connected to the PCB 161 of the integrated circuit 160 between an infrared mode and a visible light mode. As a non-limiting example, in some implementations, when the infrared mode is selected using the spectrum selector switch 156, the IR LED (L2) of the flashlight 180*a* may be turned ON/OFF when the flashlight control switch B1 is pressed; and when the visible light mode is selected using the spectrum selector switch 156, the white light LED (L1) of the flashlight 180*a* may be turn ON/OFF when the flashlight control switch B1 is pressed. As another non-limiting example, in some implementations, when the infrared mode is selected, one or more IR devices, or IR function(s) of a device, conductively connected to the PCB 161 of the integrated circuit 160 will activate (e.g., tub ON) when a switch operably connected thereto is actuated; and when the visible light mode is selected one or more devices which produce visible light, or function in visible light, will activate (e.g., turn ON) when a switch operably connected thereto is actuated. The term infrared device may refer to a near-infrared device (e.g., a night visional device), a thermal infrared device (e.g., a thermal imager), or a device that includes both near-infrared and thermal infrared functionality.

As shown in FIGS. 2 and 3, in some implementations, the ballistic helmet 100 may also include an NVG shroud 130 that is mounted on a forehead portion thereof. In some implementations, night vision goggles (NVG) may be secured to the ballistic helmet 100 by a mount that is secured to the NVG shroud 130. In some implementations, the NVG shroud 130 may include contacts that are conductively connected to the PCB 161 of the electronic circuit 160. In some implementations, the NVG shroud 130 may be configured to conductively interface directly with a NVG mounted thereto or indirectly to the NVG via the mount. In this way, the ballistic helmet 100 may be configured to operate and/or power a conductively connected NVG.

In some implementations, the electronic circuitry 160 may include one or more sockets and/or plugs that are configured to conductively connect electronic devices (e.g., an illumination device, camera, thermal imager, etc.) thereto, thereby facilitating the transfer of power, data, or a combination thereof. In some implementations, the electronic circuit 160 may include a PVS-31 plug configured to conductively interface with a night vision device (e.g., a PVS-31 binocular night vision device). In some implementations, the electronic circuit 160 may include an E-COTI plug configured to conductively interface with a thermal imaging device (e.g., an enhanced clip-on thermal imager (E-COTI)).

As shown in FIG. 10, in some implementations, the first audio (or auxiliary) switch B2, the second audio (or auxiliary) switch B3, and the third audio (or auxiliary) switch B4 may be mounted on a single printed circuit board (PCB). In some implementations, the first auxiliary switch B2, the second auxiliary switch B3, the third auxiliary switch B4, or a combination thereof, may be configured to operate one or more electronic devices conductively connected to the electronic circuit 160.

As shown in FIG. 10, in some implementations, the fourth auxiliary switch B8, the fifth auxiliary switch B9, and the sixth auxiliary switch B10 may be mounted on a single printed circuit board (PCB). In some implementations, the fourth auxiliary switch B8, the fifth auxiliary switch B9, the sixth auxiliary switch B10, or a combination thereof, may be configured to operate one or more electronic devices conductively connected to the electronic circuit 160.

Although not shown in the drawings, it will be understood that suitable wiring connects the electrical components of the ballistic helmet 100 disclosed herein.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A ballistic helmet comprising:

a first armor plate attached by a hinge to a first side of the ballistic helmet, the first armor plate is configured to provide ballistic protection;

a first lever assembly operationally connected to the first armor plate, the first lever assembly includes a lever and at least one spring and is configured to selectively position the first armor plate to shield a first ear of a wearer;

a second armor plate attached by a hinge to a second side of the ballistic helmet, the second armor plate is configured to provide ballistic protection; and a second lever assembly operationally connected to the second armor plate, the second lever assembly includes a lever and at least one spring and is configured to selectively position the second armor plate to shield a second ear of the wearer, wherein the at least one spring of the first lever assembly is configured to hold the first armor plate in a position adapted to shield the first ear of the wearer when acted upon by the lever; wherein the at least one spring of the second lever assembly is configured to hold the second armor plate in a position adapted to shield the second ear of the wearer when acted upon by the lever.

2. The ballistic helmet of claim 1, further comprising a first earcup adapter configured to be mounted on an interior side of the first armor plate and a second earcup adapter configured to be mounted on an interior side of the second armor plate; wherein each earcup adapter is configured to allow an attached earcup to rotate thereon.

3. The ballistic helmet of claim 2, wherein the first and second ear cup adapters each comprise a base having a ball joint extending therefrom, the ball joint is configured to be received within an opening located in a backside of an earcup.

* * * * *